United States Patent [19]

Dieudonne et al.

[11] Patent Number: 5,030,947

[45] Date of Patent: Jul. 9, 1991

[54] DEVICE TO GENERATE BRILLIANCE LEVELS ON A DISPLAY SCREEN

[75] Inventors: Jean Dieudonne, Colombes; Didier Verslype, Montigny les Cormeilles, both of France

[73] Assignee: Thomson-CSF, Paris, France

[21] Appl. No.: 261,174

[22] Filed: Oct. 21, 1988

[30] Foreign Application Priority Data

Oct. 30, 1987 [FR] France ..... 87 15058

[51] Int. Cl.[5] ..... G09G 3/20; G09G 3/00

[52] U.S. Cl. ..... 340/767; 340/793; 358/163

[58] Field of Search ..... 340/767, 781, 784, 805, 340/793; 358/240, 160, 163, 164, 461; 350/331 R; 382/50

[56] References Cited

U.S. PATENT DOCUMENTS

| | | | |
|---|---|---|---|
| 4,020,280 | 4/1977 | Kaneko et al. | 340/767 |
| 4,531,160 | 7/1985 | Ehn | 340/793 |
| 4,554,539 | 11/1985 | Graves | 340/793 |
| 4,581,655 | 4/1986 | Ide et al. . | |
| 4,608,558 | 8/1986 | Amstutz et al. | 340/784 |
| 4,631,576 | 12/1986 | St. John | 358/163 |
| 4,636,789 | 1/1987 | Yamaguchi et al. | 340/781 |
| 4,661,809 | 4/1987 | Anderson et al. | 340/793 |
| 4,698,685 | 10/1987 | Beaverson | 358/163 |

FOREIGN PATENT DOCUMENTS

| | | |
|---|---|---|
| 2006569 | 5/1979 | United Kingdom . |
| 2047453 | 11/1980 | United Kingdom . |
| 2070308 | 9/1981 | United Kingdom . |
| 2109976 | 6/1983 | United Kingdom . |

*Primary Examiner*—Jeffery A. Brier
*Assistant Examiner*—M. Fatahiyar
*Attorney, Agent, or Firm*—Roland Plottel

[57] ABSTRACT

A device for generating levels of brilliance on a display screen. The device has a code-voltage converter, controlled by an asynchronous clock which makes a specific conversion of binary codes into discrete control voltages. These voltages are applied to the cells of the screen thus generating brilliance levels. The asynchronous clock is such that the control voltages generate levels of brilliance which evenly spaced over the luminance range.

7 Claims, 9 Drawing Sheets

$C_j$
$C_l$
$U_k$
$U_m$
$L_i$
$L_n$
-V
0
1
2
3
4
5

$C_j$
$C_l$
$U_o$
$U_p$
$L_i$
$L_{i+1}$
$L_n$
0
-V
0
1
2
3
4
7
8
9

DEVICE TO GENERATE BRILLIANCE LEVELS ON A DISPLAY SCREEN

BACKGROUND OF THE INVENTION

1. Field of the Invention

The present invention concerns a device to generate brilliance levels on a display screen. This device can be used to make a so-called static correction and/or a so-called dynamic correction of homogeneity defects in the screen.

As is known, certain types of display screens comprise a set of cells: each cell is a portion of the screen defined by the intersection of a so-called row electrode with a so-called column electrode. A control voltage is applied to each cell which is then capable of emitting light. The quantity of light emitted by a cell is measured, for example, in terms of luminance. The luminance is a function of the control voltage, according to a curve, hereinafter called a characteristic, which depends on the specific qualities of the screen at the cell considered.

Prior art methods for manufacturing display screens are aimed at obtaining screens that are as homogeneous as possible. As a first approximation, it can be considered that a single characteristic is valid for the entire screen. However, it is sometimes necessary to consider different characteristics for various parts of the screen.

As is known, a screen characteristic takes the following form:

below a threshold voltage, there is no transmission of light;

then the luminance increases with the control voltage;

from a saturation voltage onwards, the luminance is constant and keeps a maximum value; this characteristic therefore defines a range of luminance.

2. Description of the Prior Art

There are known methods to apply discrete, control voltage values, making it possible to obtain degrees of luminance, hereinafter called brilliance levels.

A prior art device, marketed under the reference HV01 and made by the firm SUPERTEX, is capable of delivering discrete voltage values that are evenly spaced out.

This device, applied to the electrodes of the different cells of a display screen according to a method that shall be explained below, generates brilliance levels. Unfortunately, owing to the shape of the characteristic, these brilliance levels are very poorly distributed over the luminance range.

SUMMARY OF THE INVENTION

An object of the invention is a device capable of delivering discrete voltage values, which are not evenly spaced out but are such that they generate brilliance levels which evenly cover the range of luminance.

Furthermore, this device is capable of correcting differences in luminance corresponding to one and the same level of brilliance, due to homogeneity defects in the screen. A correction of this type can be made if one or more characteristics per screen are considered, and it provides for greater efficiency in the manufacture of display screens, through a selection which is less strict with respect to their homogeneity.

More precisely, an object of the invention is a device to generate levels of brilliance on a display screen comprising means for the biunique conversion of binary codes into discrete control voltages, said voltages being applied to the cells of the screen and thus generating levels of brilliance, wherein said conversion means comprise asynchronous clock means enabling the generation of control voltages such that said brilliance levels are evenly spaced out in the luminance range.

BRIEF DESCRIPTION OF THE DRAWINGS

Details, specific features and different embodiments of the invention will appear in the following description, made with reference to the appended figures, of which.

These various figures have not been drawn to scale and, moreover, the same references are repeated for the same elements.

DESCRIPTION OF PREFERRED EMBODIMENTS

Figure 1:
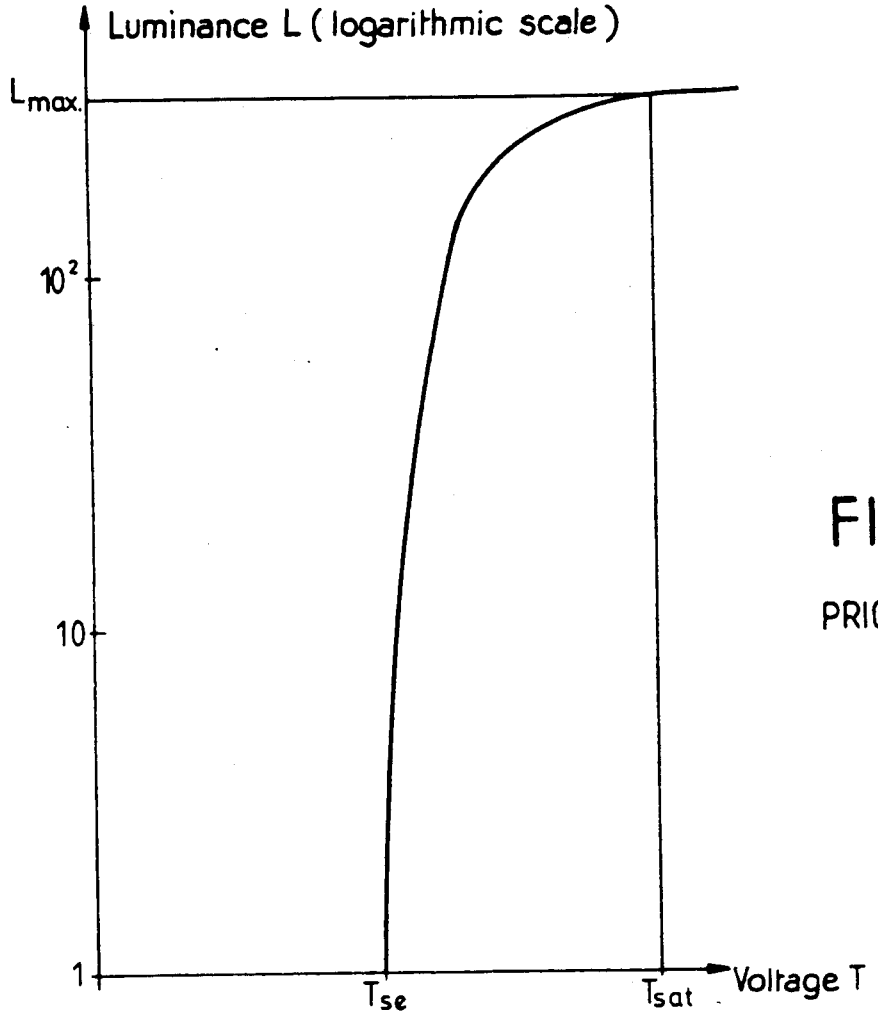
FIG. 1 PRIOR ART
FIG. 1 shows the known shape of a characteristic of at least one part of a display screen.

FIG. 1 gives the shape of a characteristic of at least one part of a display screen. The luminance L is represented on the y-axis on a logarithmic scale and the control voltage T is represented on the x-axis on a linear scale. The figure shows the threshold voltage $T_{se}$, the saturation voltage $T_{sat}$, and the maximum luminance $L_{max}$ which limites the luminance range.

Figure 2:
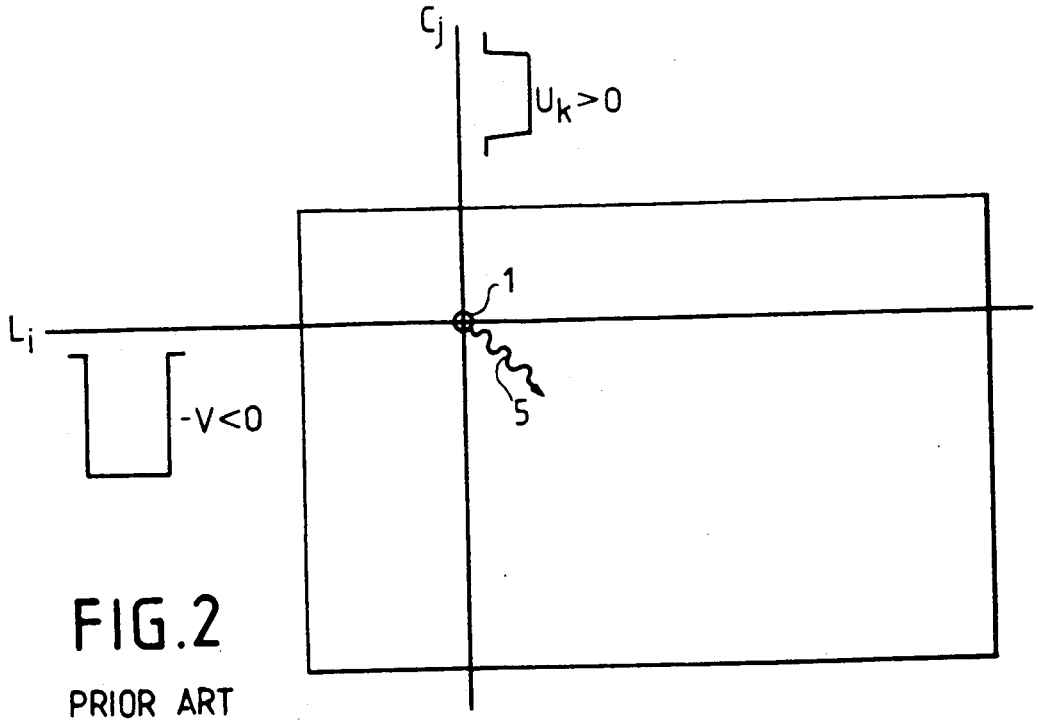
FIG. 2 PRIOR ART
FIG. 2 shows a prior art method for applying a control voltage to a given cell of a display screen.

FIG. 2 shows a mode of application of a control voltage to a given cell 1 of a display screen identified by its row $L_i$ and its column $C_j$.

To the cell 1 there is applied:

a positive column voltage $U_k$, selected from among N discrete values $U_0, U_1 \ldots U_{N-1}$. The same voltage is not necessarily applied to all the rows of the screen;

a strictly negative and fixed row voltage $(-V)$; the same voltage is applied sequentially to all the rows of the screen.

The control voltage applied to the cell 1 is the combination of the row voltage and the column voltage, namely $(U_k+V)$. The column voltages and the row voltage should not be chosen at random but in accordance with the threshold voltage and the saturation voltage of the screen considered and as follows:

the absolute value V of the row voltage is smaller than or equal to the threshold voltage;

the column voltage $U_0$ is zero:the combination: of the row voltage (−V) and this column voltage causes no light emission or little light emission; the level of brilliance obtained is considered to be zero;

the column voltages U1 to $U_{N-1}$ are strictly positive; they are smaller than or equal to the threshold voltage, and are such that the combination of the row voltage (−V) and any one of these N-1 column voltages $U_k$, at each cell, is included between the threshold voltage and the saturation voltage: thus, N-1 levels of brilliance, considered as being not zero, are obtained. In the example chosen in FIG. 2, the voltage applied to the column $C_j$, marked $U_k$ on this figure, is strictly positive. The cell 1 thus emits light, and this light is shown schematically by the arrow 5.

Figure 3:
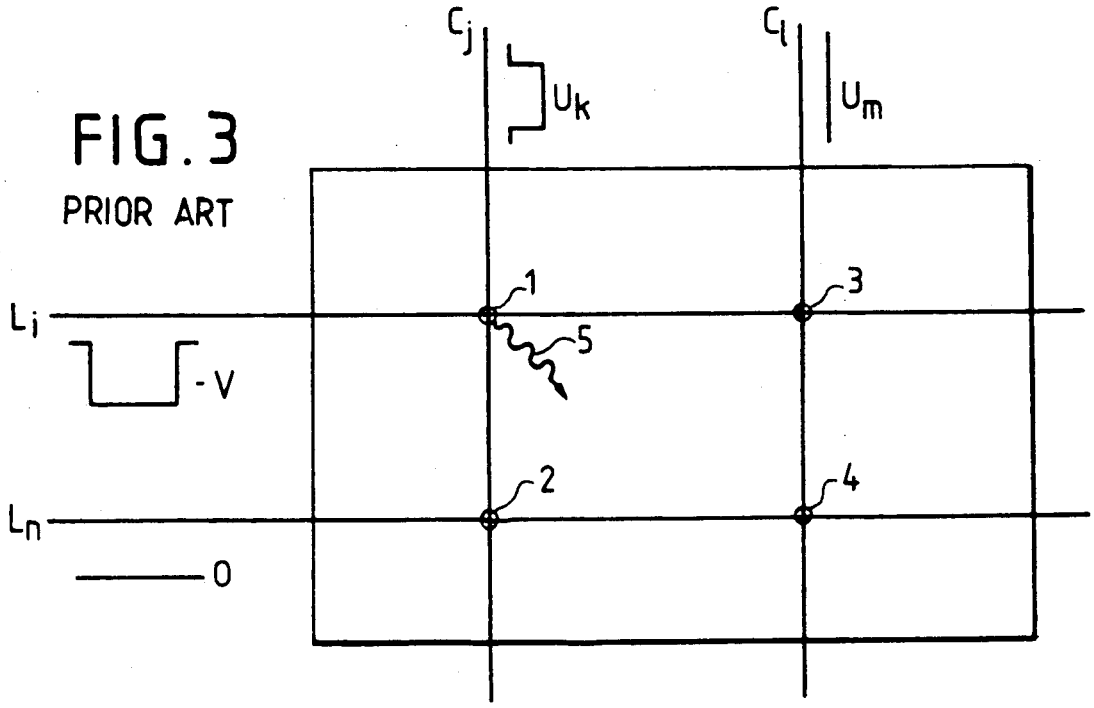
FIG. 3 PRIOR ART
FIGS. 3 and 4 show a prior art method for applying the different control voltages to all the cells of the screen.
Figure 4:
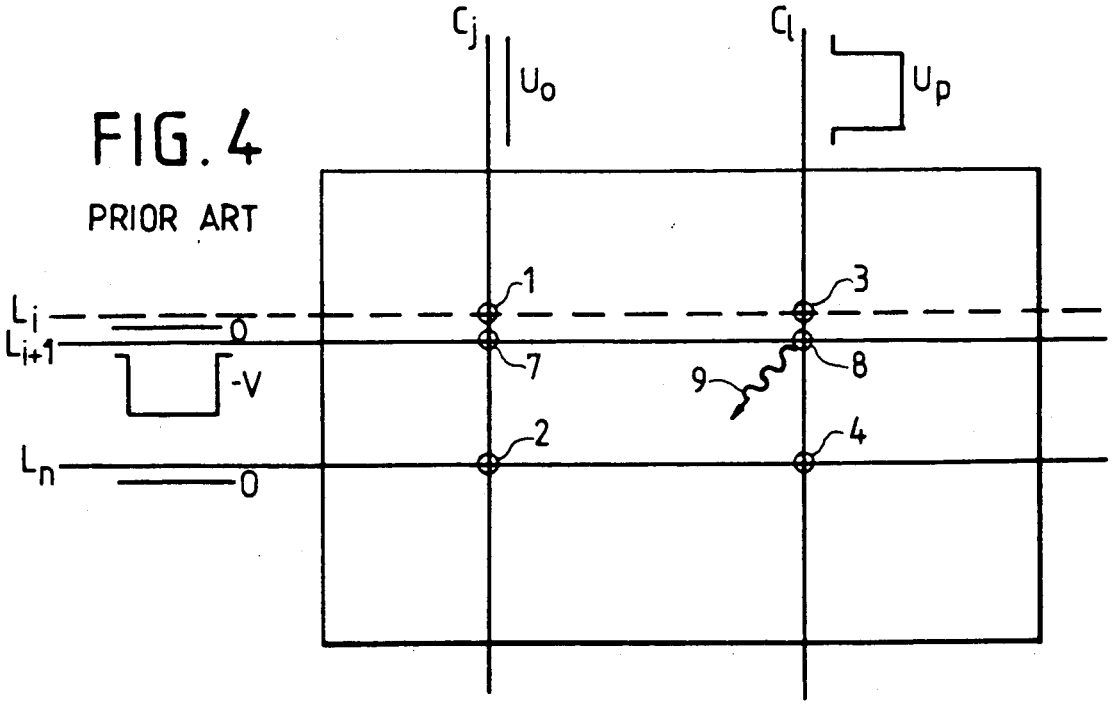
FIG. 4 PRIOR ART

FIGS. 3 and 4 illustrate a prior art method for the application of different control voltages to the different screen cells.

As shown in FIG. 3, first of all a column voltage . . . $U_k$ . . . $U_m$ . . . is applied simultaneously to all the columns . . . $C_j$ . . . $C_l$ each column voltage being of the type described above. In the example chosen in FIG. 3, the cells 1 and 2, 3 and 4, respectively, of one and the same column $C_j$, $C_l$ respectively, are subjected to the same voltage $U_k$, $U_m$ respectively. On the contrary the cells of two different columns may be subjected to different voltages, namely, it is possible to have $U_k$ different from $U_m$ as already described.

Then, as shown in the same FIG. 3, the row voltage (−V) is applied to a given row $L_i$ and a null voltage is applied to the other rows $L_n$. Since the row voltage (−V) and each column voltage $U_k$ taken separately, are smaller than or equal to the threshold voltage, only the cells of the row $L_i$ are capable of emitting light: in the example chosen in FIG. 3, the cells 2 and 4 do not emit any light. Among the cells of the row $L_i$, only those belonging to a column to which a strictly positive voltage has been applied emit light. In the example of FIG. 3, the cell 3 emits no light while the cell 1 emits light: this emission of light is shown schematically by the arrow 5.

Then, all the cells are brought to a zero voltage.

Then, as shown in FIG. 4, a column voltage . . . $U_o$ . . . $U_p$ . . . is again applied simultaneously to all the columns . . . $C_j$ . . . $C_l$ . . . in the same way as previously. The voltages applied to the column $C_j$, on the one hand, and to the column $C_l$, on the other hand, may be different from those applied previously.

Then, the row voltage (−V) is applied to the following row $L_{i+1}$, and a zero voltage is applied to the other rows (including the row $L_i$). In the example of figure 4, the cells 1, 3, 2, 4, emit no light for these rows $L_i$ and $L_n$ are subjected to a zero voltage. Nor does the cell 7 emit any light for the column voltage $U_o$ is zero. On the contrary, the cell 8 emits light for $U_p$, applied to the column $C_l$, is strictly positive. This emission of light is shown schematically by the arrow 9.

The cells are all brought to zero voltage again and the operations are continued, namely:

all the columns are supplied simultaneously;

a row of the screen is scanned;

the cells are brought to zero voltage; this procedure being followed successively for all the rows of the screen.

The display screen to which the invention can be applied without discrimination to a liquid crystal screen, a plasma screen or an electroluminescent screen. As a non-exhaustive example, a electroluminescent screen shall be considered hereinafter.

Figure 5:
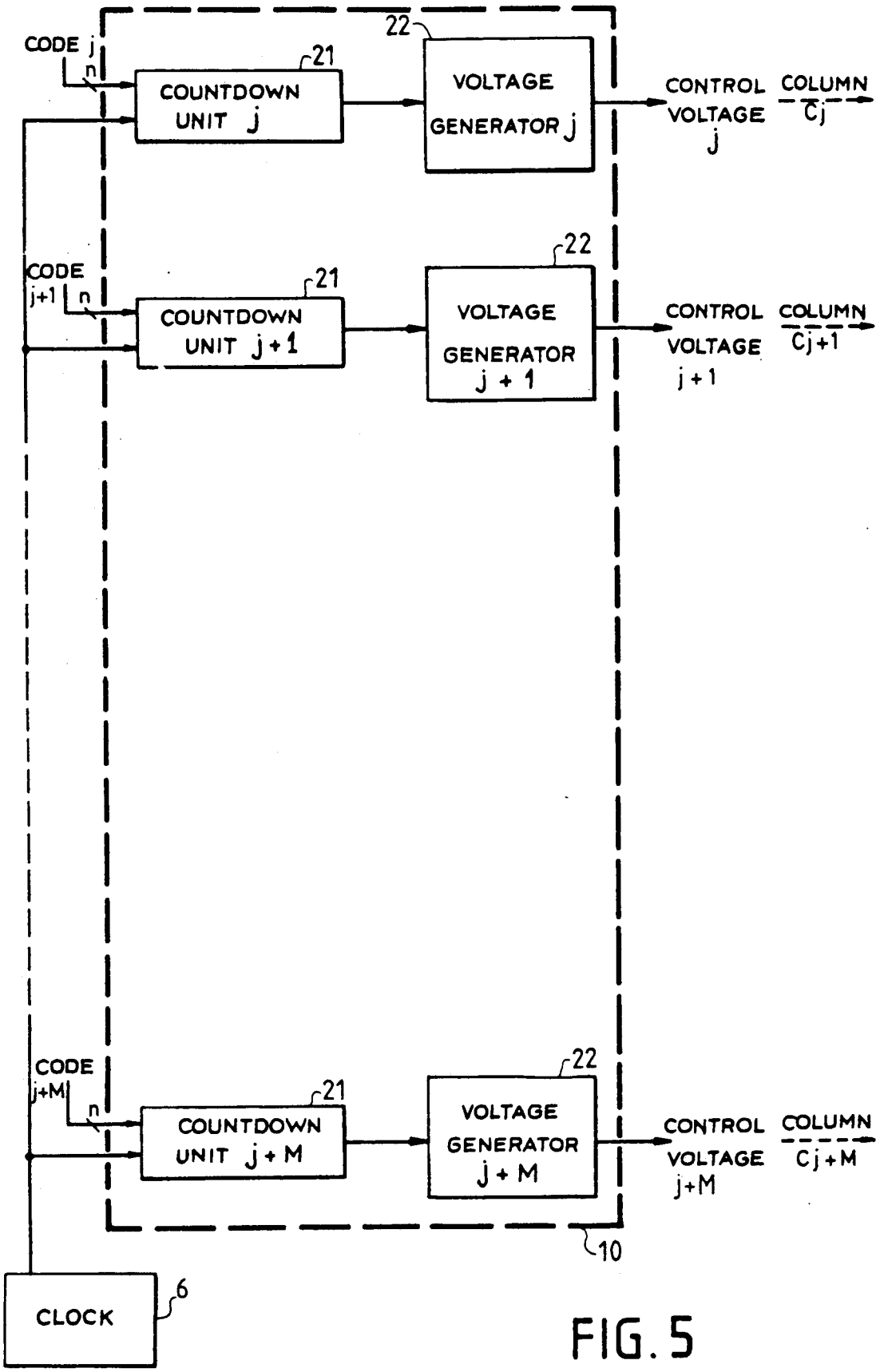
FIG. 5 PRIOR ART
FIG. 5 shows the prior art device marketed under the reference HV01.

FIG. 5 shows the prior art device marketed under the reference HV01 (mentioned above) which biuniquely converts M binary codes with n bits into M discrete control voltage values capable of assuming $N=2^n$ discrete values. In the case of this device HV01, in fact M=16 and n=4, whence N=16 (the values of M and N are independent).

These M voltages are applied to M columns of the screen, for example according to the mode shown in the description of FIGS. 2, 3 and 4, and are then capable of causing a light emission by different cells of the screen, thus generating $N=2^n$ brilliance levels which correspond biuniquely to the N control voltage values as well as to the N possible binary codes.

The M voltages of a given circuit HV01 are preferably applied to M successive columns of the screen. In FIG. 5, the indices of M outputs of the device HV01 and those of the M columns to which they are connected are identical.

In the case where the structure of the screen is interdigitated, i.e., where the even-parity columns are supplied through one side (called the north) of the screen and the odd-parity columns are supplied through the opposite side (called the south) of the screen, the M outputs of a circuit HV01 are preferably applied to M successive even-parity columns (namely every other column), and the M outputs of a second circuit HV01 are applied to M successive odd-parity columns (i.e., here again to every other column). The control voltages given by each of these two circuits HV01 are of course correlated.

Regardless of the topology of the connections between the outputs of at least one circuit HV01 and the columns of the screen, it is quite clear that the number of columns of this screen should be a multiple of the number M of outputs of a circuit HV01.

More precisely, the prior art device has:

M count-down devices 21, for example indexed j to j+M;

as many voltage generators 22 as count-down devices 21 (these generators 22 are also indexed j to j+M);

a clock 6 (giving pulses that are located at regular intervals in time).

To simplify the rest of the description, the set consisting of M count-down devices 21 and M generators 22 is marked 10 and called a "code-voltage converter". It is controlled by the clock 6. M binary codes with n bits are injected simultaneously and respectively into the M count-down devices 21 (these codes are also indexed j to j+M).

A given count-down device 21, for example the one with the index j, emits a beep at the $x^{th}$ pulse delivered by the clock 6, the whole number x corresponding biuniquely to the binary code j. This beep is sent by the generator 22 having index j, and causes the generation of a discrete voltage value, among $N=2^n$ possible values, this value also corresponding biuniquely to the binary code j. This voltage is applied to the column $C_j$ of the screen.

The specific feature of the prior art device is related to the fact that the pulses given by the clock 6 are located at regular intervals in time and, consequently, the discrete control voltage values are evenly spaced out with respect to one another, thus raising a problem of distribution of the brilliance levels as explained in the above.

Figure 6:
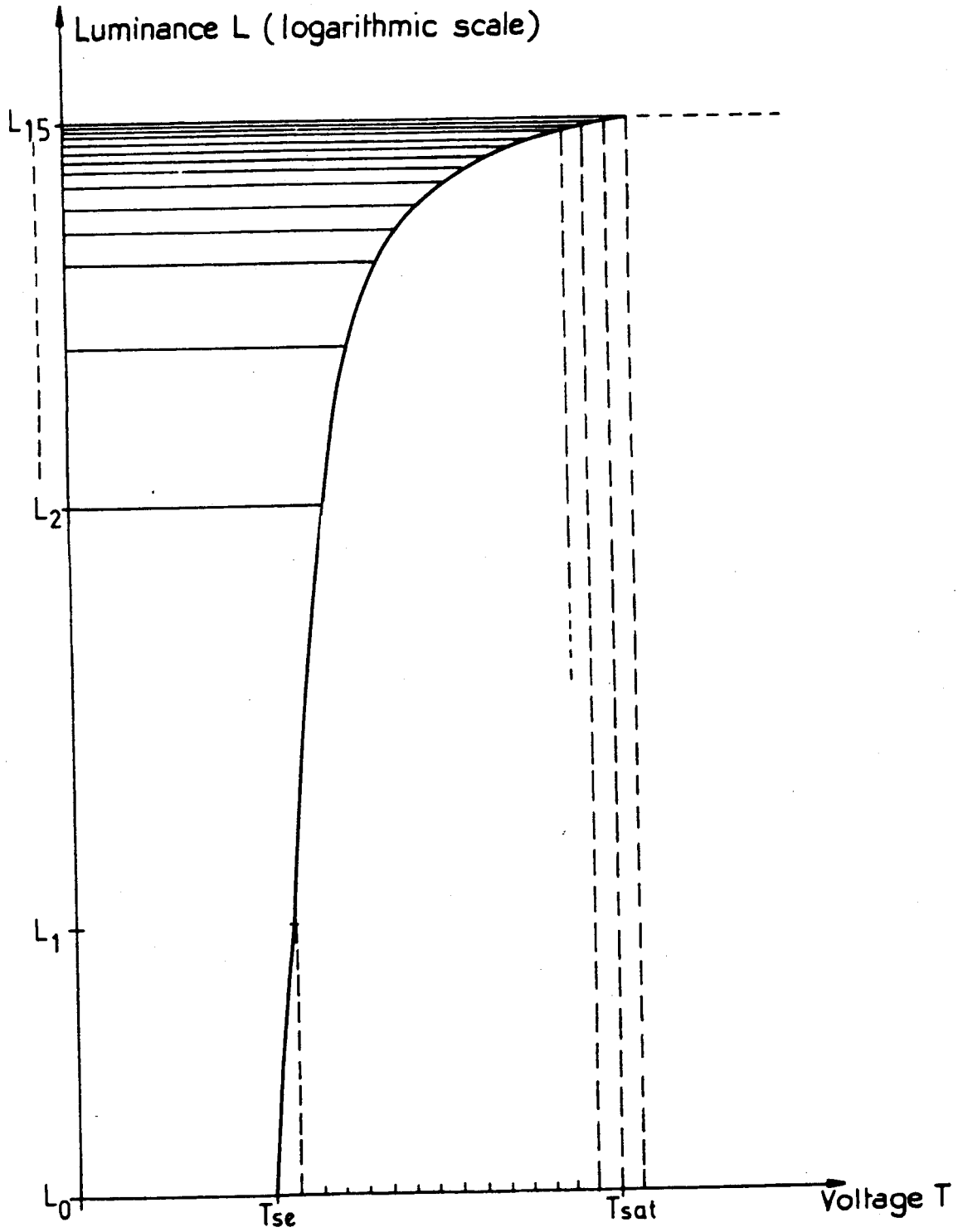
FIG. 6 PRIOR ART
FIG. 6 shows the distribution of brilliance levels obtained with the prior art device.

This problem is illustrated by FIG. 6. This figure represents the distribution of N levels of brilliance $L_i$ obtained with a set of N discrete control voltage values which are evenly spaced out. These N levels of brilliance $L_i$ are very poorly distributed over the luminance range and, especially, there are far too few of them for low luminance values. In FIG. 6 N has been taken to be equal to 16, and the brilliance levels $L_i$ ae indexed 0 to 15.

The device according to the invention is used to generate discrete control voltage values which are unevenly spaced out, but chosen so as to generate brilliance levels that evenly cover the luminance range. More precisely, these brilliance levels are evenly spaced out on a logarithmic scale. A situation of this type is illustrated by FIG. 7 for N=8.

This figure further illustrates a method for otaining, according to an embodiment of the device according to the invention, N discrete voltage values providing for brilliance levels of this type.

Figure 7:
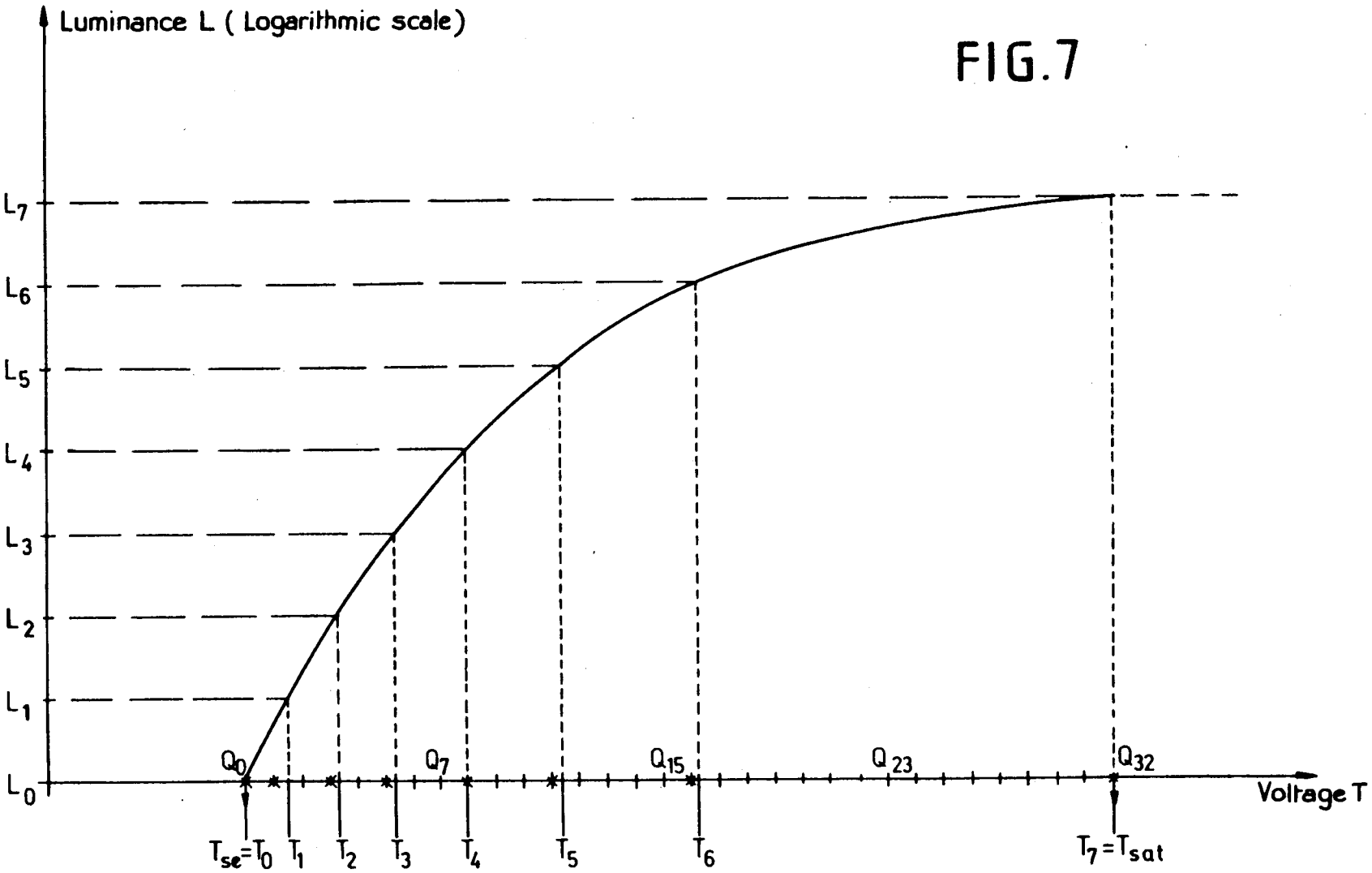
FIG. 7 shows the distribution of brilliance levels obtained with the device according to the invention, and a method for obtaining the corresponding control voltages.

A given characteristic, like that of FIG. 7, is used to determine N voltage values $T_i$ from N brilliance levels $L_i$ evenly spaced out on a logarithmic scale, these N voltage values $T_i$ enabling, in turn, the selection of N voltage $Q_i$ values from among X possible values, said X voltage values being obtained by quantifying the voltage interval demarcated on one side by the threshold voltage $T_{se}$ and, on the other side, by the saturation voltage $T_{sat}$. The N selected values $Q_i$ are those of the X possible values which are closest to the N values $T_i$. In FIG. 7, X is equal to 32; the eight brilliance levels indexed 0 to 7 define eight values of voltages $T_0, T_1, \ldots T_7$ enabling the selection of the eight values $Q_0, Q_1, Q_3, Q_5, Q_8, Q_{11}, Q_{16}$ and $Q_{31}$ which are chosen as control voltages. The greater the number X, the closer are the $Q_i$ values chosen to the desired values $T_i$. Hence, the greater the number X, the greater is the precision in the values of the control voltages.

Figure 8:
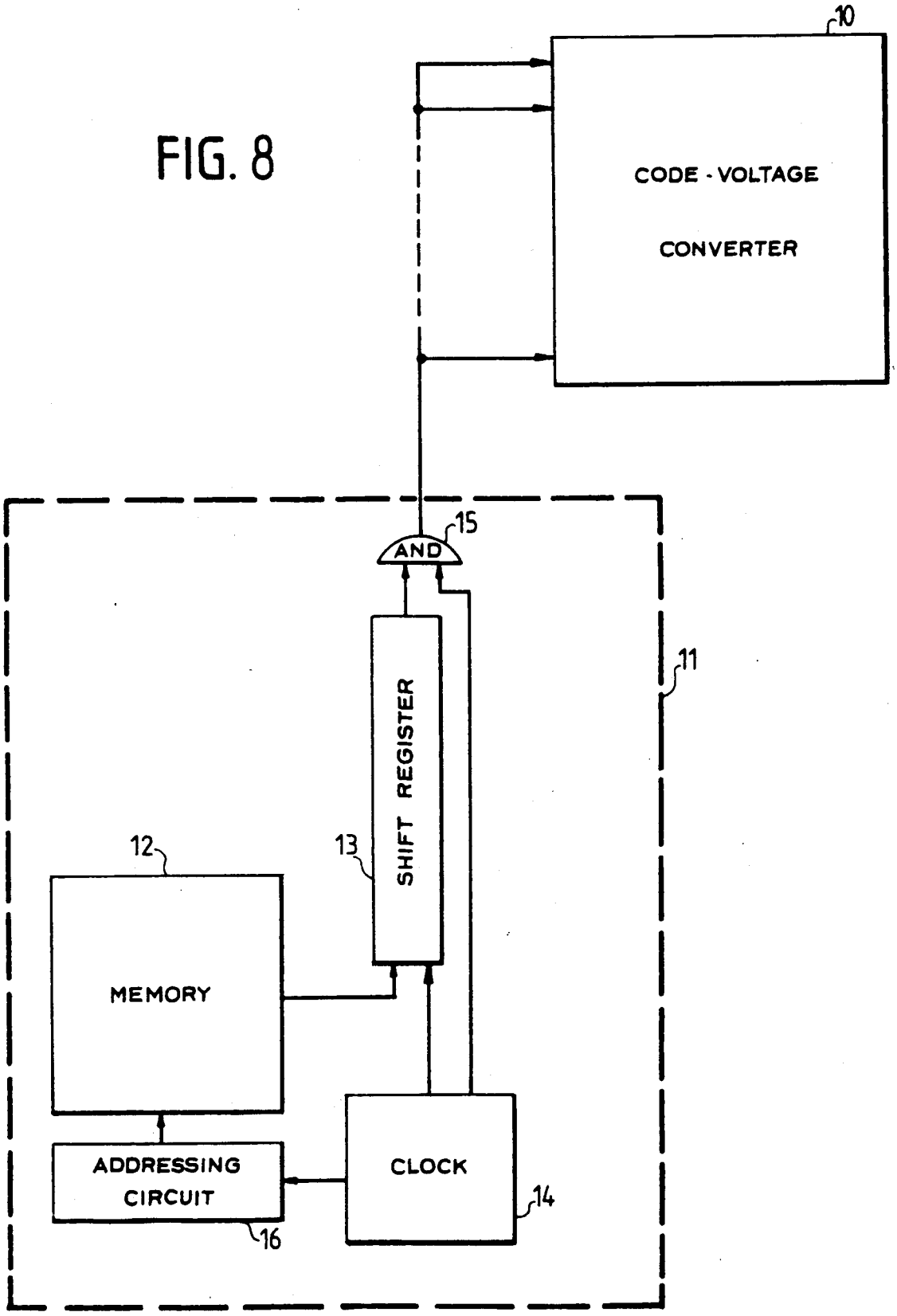
FIG. 8 shows a first embodiment of the device according to the invention.

FIG. 8 shows a first embodiment of the device according to the invention. According to this embodiment, the screen is considered to be sufficiently homogeneous to be associated with a single characteristic. The device considered comprises, firstly, the code-voltage converter 10 of the prior art device (shown in detail in FIG. 5) and, secondly, instead of the clock 6, a set 11 which comprises:

a non-volatile memory 12, such as, for example, a ROM;

a memory 12 addressing circuit 16;

a shift register 13 with X moments;

a clock 14 (giving pulses that are located at regular intervals in time), with a given frequency marked f;

an AND gate 15.

In the non-volatile memory 12, X one-bit binary words are stored beforehand. Among these X words, N equals "1" and (X-N) equals "0". After a zero-setting of the shift register 13, the addressing circuit 16 sends successive commands to read the X words stored in the memory 12, in a pre-defined order, at the frequency f of the clock 14. These X words are introduced at the same frequency f and synchronously in the shift register 13. At the end of X clock pulses 14, the shift register 13 is thus completely charged. It has a sequence of X bits "1" or "0", the distribution of which depends on the predefined reading order of the content of the memory 12. This order corresponds to the choice of the N discrete control voltage values chosen from among X possible values as explained in the description of FIG. 7. In the case illustrated by the FIG. 7, the shift register 13 has the sequence of 32 bits:

10000000000000010000100100101011 with the first bit capable of leaving the shift register 13 being the one to the right. These X "1" or "0" bits are successively introduced at the frequency f of the clock 14 in the "AND" gate 15. Each bit "1" causes a pulse at the output of the AND gate 15 which is injected into the set 10 while, on the contrary, each bit "0" causes no pulse. The set 11 therefore forms a device, hereinafter called an asynchronous clock, which manufactures pulses that are located at irregular intervals in time, unlike those generated by the clock 6 of the prior art device.

This asynchronous clock 11, applied to the code-voltage converter 10, makes it possible to deliver $N=2^n$ voltages capable of generating $N=2^n$ levels of brilliance which are evenly spaced out on a logarithmic scale, i.e. as desired.

Figure 9:
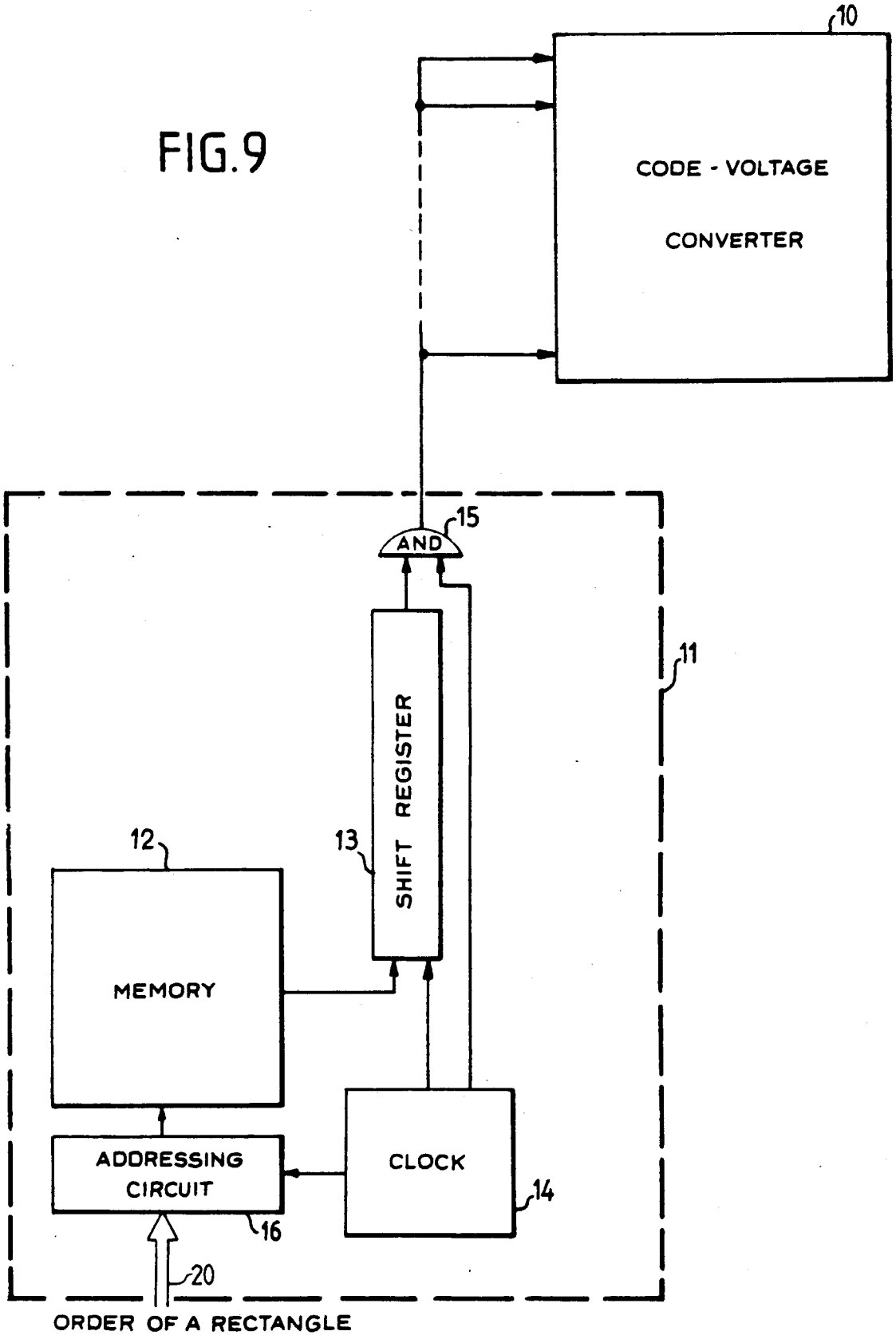
FIG. 9 shows a second embodiment of the device according to the invention.

FIG. 9 shows a second embodiment of the device according to the invention, which takes into account homogeneity defects, if any, in the screen and corrects them by a so-called static correction.

A "non-homogeneous" screen may be divided into rectangles assumed to be "homogeneous" (for each one of which a single characteristic may be considered). When the luminance gradient on the screen is low, the screen can be divided into rectangles which are large enough to comprise a number of columns at least equal;

to the number M of outputs of the device according to the invention if the screen does not have an interdigitated structure;

to twice this number M if this structure of the screen is interdigitated. The number of rows of these rectangles is arbitrary. As an example, a screen divided into Z rectangles of identical sizes is considered, and these Z rectangles are identified by their position on the screen (in rows and columns) hereinafter referred to as their order.

The said static correction consists in processing the screen rectangle by rectangle and not comprehensively. The biunique conversion of binary codes into control voltages depends on the rectangle considered. The second embodiment differs from the first one in the size and content of the memory 12 and in the fact that the device further has an input 20 of the order of the different rectangles in the addressing circuit 16. In the memory 12, there are stored Z sets (instead of only one set) of binary words with N bits. Each set corresponds to the characteristic of a given rectangle. To process a rectangle, its order must be introduced in the addressing circuit 16 so that the memory 12 charges the shift register 13 with a sequence of bits equal to "1" or "0", which corresponds to the characteristic of the rectangle considered.

Figure 10:
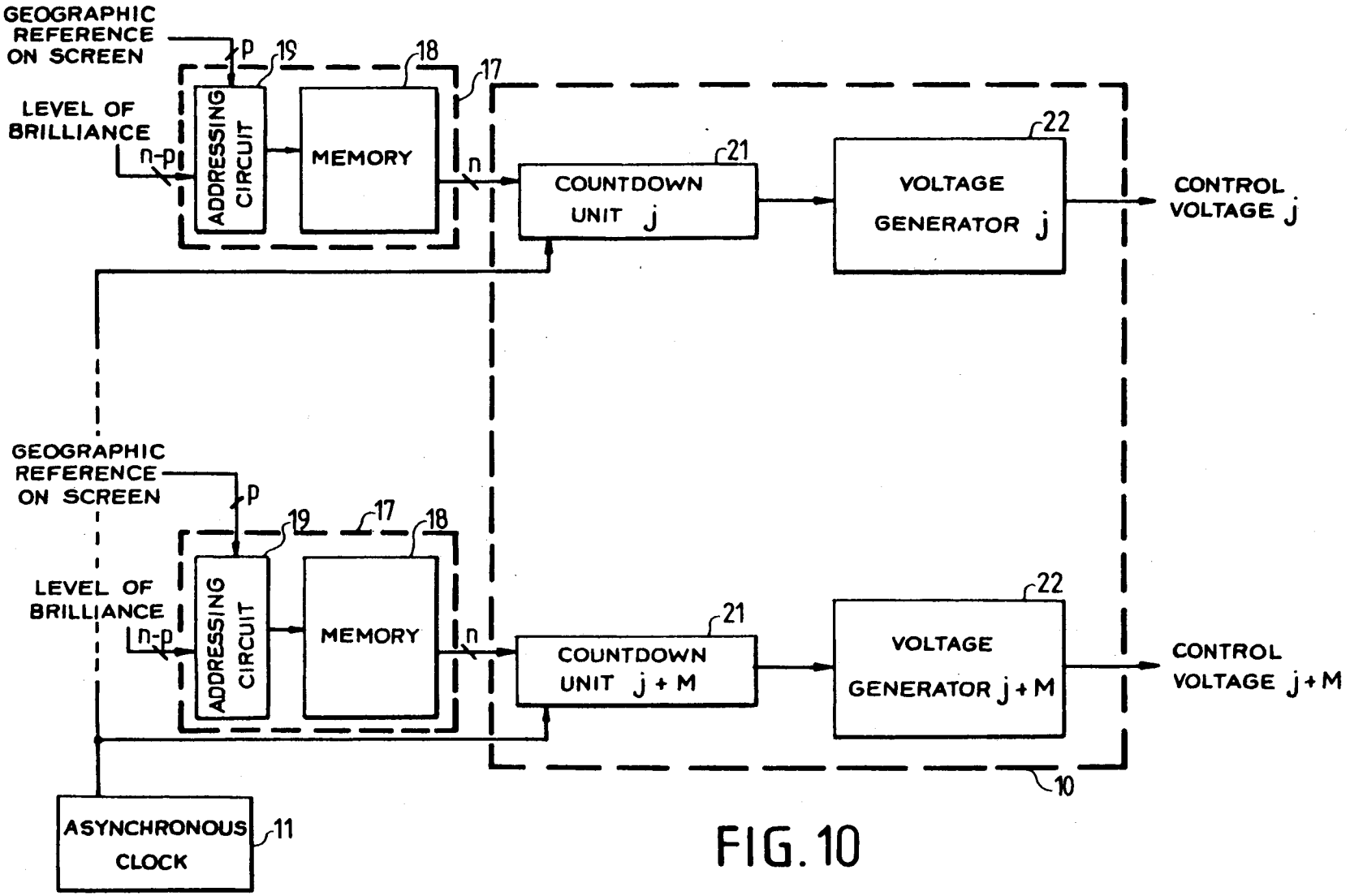
FIG. 10 shows a third embodiment of the device according to the invention.

FIG. 10 shows a third embodiment of the device according to the invention, which takes into account any defects in homogeneity of the screen, like the second embodiment, but corrects them by a so-called dynamic correction, which is different in nature and is independent from the static correction referred to in the description of FIG. 9. Ths dynamic correction is not necessarily applied rectangle by rectangle. It can be applied comprehensively to the entire screen.

The said dynamic correction consists in associating several control voltages with a given level of brilliance, the selection of one of the control voltages depending on the zone of the screen considered. The same level of brilliance can therefore be generated by different control voltages.

This correction therefore implies a reduction in the number of levels of brilliance as compared with a first embodiment of the device according to the invention (at equal control voltage values).

The device according to this third embodiment comprises, in addition to the elements of the device according to the first embodiment, M transcoding sets 17, respectively connected to the input of the M count-down devices 21 j . . . j+m of the code-voltage converter 10. Each set 17 comprises:

a non-volatile memory such as, for example, a ROM;

an addressing circuit 19 for this memory 18.

The information designed to select a control voltage comprises (n-p) bits concerning the brilliance level (where $0<p<n$) and p bits concerning the geographic reference of the zone of the screen considered. This information is introduced into a given set 17, which delivers an n-bit binary code depending on said p bits of information in the zone of the screen considered, and which is delivered to the count-down device 21 connected to the set 17 considered. This binary code is then converted into a control voltage as in the first embodiment of the invention.

Figure 11:
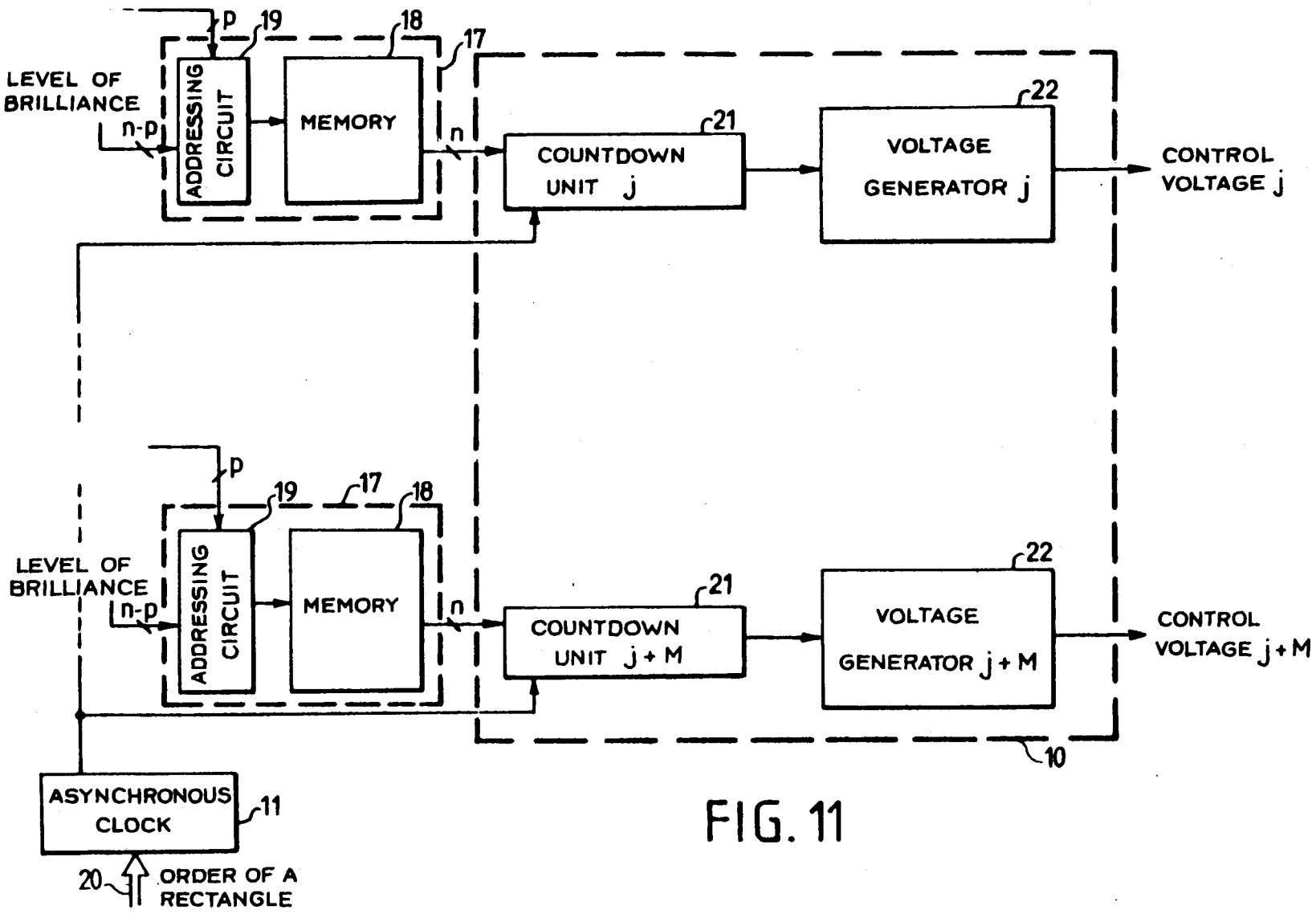
FIG. 11 shows a fourth embodiment of the device according to the invention.

FIG. 11 shows a fourth embodiment of the device according to the invention, enabling a correction in the homogeneity defects of the screen through both the above-mentioned ways at the same time, namely by combining a static correction with a dynamic correction. The screen is processed rectangle by rectangle, as explained in the description of FIG. 9, and the zone of the screen considered, referred to in the description of FIG. 10, consists of a sub-rectangle obtained by dividing the rectangle, for which the order is introduced in the asynchronous clock 11 by the input 20, into $2^P$ parts.

This fourth embodiment is especially valuable when the structure of the screen is interdigitated and when a rectangle, comprising at least two times M columns, may be big enough to have homogeneity defects. According to this fourth embodiment, a smaller number of brilliance levels is obtained than in the second embodiment, but with, on the contrary, excellent correction of homogeneity defects in the screen.

The above-mentioned four embodiments of the device according to the invention use the part 10 of a circuit HV01. Consequently, the device obtained in each of these four cases gives $M=16$ control voltages which can assume $N=2^n$, with $n=4$, namely $N=16$ different discrete values. A device using another control circuit, capable of delivering a number M of control voltages, different from 16 (preferably greater than 16), capable of taking a number $N=2^n$ different from 16 (preferably also greater than 16), comes within the scope of the invention.

Furthermore, it has been pointed out that the number of columns of the screen has to be a multiple of said number M, the number of rows of the screen being not subject to any constraint. From the above paragraph, it can thus be seen that the device according to the invention may be applied to a screen of any size (this size being, however, quantified in columns).

In a preferred embodiment of the device according to the invention, a device comprising the part 10 of a circuit HV01 is considered. It generates $M=16$ control voltages from binary codes with $n=4$ bits, the control voltages being capable of assuming $N=16$ discrete values chosen from among $X=64$ and corresponding to the description of FIG. 11, namely performing, at the same time, both a static correction and a dynamic correction of any homogeneity defects in the screen.

This screen is sub-divided into rectangles comprising eight rows and:

either 16 columns where the structure of the screen is not interdigitated;

or 32 columns, on the contrary,

A rectangle is itself divided:

either into two sub-rectangles (not necessarily identical) in which case there are $p=1$ reference bits of the sub-rectangle and $n=3$ information bits on the brilliance level, thus giving $K=8$ brilliance levels;

or into four sub-rectangles (which do not necessarily have the same size). In this case, there are $p=2$ reference bits of the sub-rectangle and $n=2$ information bits on the brilliance level, thus giving only $K=4$ levels of brilliance.

What is claimed is:

1. A device for the generation of levels of brilliance on a display screen having cells, said device comprising conversion means for conversion of binary codes into discrete control voltages, means for applying said voltages being applied to said cells of said screen and thus generating levels of brilliance, said conversion means having asynchronous clock means providing for a generation of control voltages such that said brilliance levels are evenly spaced in the luminance range.

2. A device according to claim 1, wherein said screen is divided into a plurality of Z rectangles, each of which is identified by its order, and wherein said asynchronous clock means comprises means for providing for a generation of control voltages depending on the order of each rectangle, thereby enabling a static correction of homogeneity defects in said screen.

3. A device according to claim 1, further comprising transcoding means for receiving input binary codes containing information on the level of brilliance desired and information representing the zone of the screen considered, and for delivering binary codes introduced in said conversion means, thus enabling a dynamic correction of the homogeneity defects of said screen.

4. A device according to claim 1 wherein said conversion means comprise a code-voltage converter consisting of:

M count-down devices;

M voltage generators respectively connected to the output of said M count-down devices; M n-bit binary codes being injected simultaneously and respectively into said M count-down devices, each count-down device emitting a pulse at the xth pulse give by said asynchronous clock means, x being a whole number corresponding specifically to the binary code injected into said count-down device, said pulse being sent into the generator connected to said count-down device and causing the generation of a control voltage, said M binary codes being converted into M control voltages, and wherein said asynchronous clock means (11) comprises:

a clock;

a memory;

an addressing circuit of said memory, connected to said clock;

a shift register with X moments working at the frequency of said clock, the input of which is connected to said memory;

an "AND" gate, the inputs of which are connected to the output of said register and to said clock;

said addressing circuit sending orders, at the frequency of said clock, for successive readings of binary codes contained in said memory, said binary codes being delivered in the form of sequences of bits to said shift register, said register being shifted at the frequency of said clock, and said gate being capable of delivering, depending on the nature of the information coming from the shift register, a pulse constituting an output of said asynchronous clock means.

5. A device according to claim 2 wherein said asynchronous clock means comprise:

a clock (14);

a memory (12);

an addressing circuit (16) of said memory, having a first input connected to said clock and a second input (20) for receiving the order of one of said rectangles;

a shift register (13) with x moments working at the frequency of said clock, the input of which is connected to said memory;

an "AND" gate (15), the inputs of which are connected to the output of said register and to said clock;

said addressing circuit sending orders, at the frequency of said clock, for successive readings of selected binary codes, selected from said binary codes contained in said memory through the introduction of the order of a rectangle through said second input, said binary codes being delivered in the form of a sequence of bits to said shift register, said shift register being shifted at the frequency of said clock, and said gate being capable of delivering, according to the nature of the information coming from said shift register, pulse constituting an output of said asynchronous clock means.

6. A device according to claim 3 wherein said conversion means comprise a code-voltage converter consisting of:

M count-down devices;

M voltage generators respectively connected to the output of the M count-down devices;

M n-bit binary codes being injected simultaneously and respectively into said M count-down devices, each count-down device emitting a pulse at the xth pulse given by the asynchronous clock means, x being a whole number corresponding specifically to the binary code introduced into said count-down device, said pulse being sent into the generator connected to said count-down device and causing the generation of a control voltage, said M binary codes being converted into M control voltages, and wherein said transcoding means consist of M circuits respectively connected to the inputs of said M count-down devices and each having a memory and its addressing circuit, each of said circuits:

receiving said information on the desired level of brilliance in the form of (n-p), with $0<p<n$, and said information representing the zone of the screen considered in the form of p bits;

delivering n bits forming said binary code injected into the count-down unit connected to the set considered.

7. A device according to claim 2 comprising, inter alia transcoding means receiving input binary codes containing a piece of information on the desired level of brilliance, and a piece of information on the zone considered of the screen, said transcoding means delivering binary codes introduced into said conversion means, enabling a combination of a static correction and a dynamic correction of the homogeneity defects of the screen, each rectangle being divided into sub-rectangles each constituting said zone of the screen considered for the dynamic correction.

* * * * *